United States Patent [19]

Mattei

[11] Patent Number: 4,519,406

[45] Date of Patent: May 28, 1985

[54] DEVICE FOR APPLYING FILTERS TO CIGARETTES

[75] Inventor: Riccardo Mattei, Bologna, Italy

[73] Assignee: G.D. Società per Azioni, Bologna, Italy

[21] Appl. No.: 559,826

[22] Filed: Dec. 9, 1983

[30] Foreign Application Priority Data

Dec. 22, 1982 [IT] Italy ..... 3630 A/82

[51] Int. Cl.[3] ..... A24C 5/52

[52] U.S. Cl. ..... 131/94; 131/95; 131/286

[58] Field of Search ..... 131/93, 94, 95, 282, 131/286, 289; 198/416

[56] References Cited

U.S. PATENT DOCUMENTS 4,237,907 12/1980 Pawelko et al. ..... 131/94

4,409,996 10/1983 Seragnoli ..... 131/95

4,431,010 2/1984 Seragnoli ..... 131/94

*Primary Examiner*—Vincent Millin

*Assistant Examiner*—Harry Macey

[57] ABSTRACT

A device for applying filters to cigarettes, in which a conveyor roller, provided with a plurality of peripheral axial seats for respective groups constituted by at least one cigarette and a filter tip which are axially aligned, cooperates with a rolling device provided with a support member rotatable about a first axis and rotatably supporting in an eccentric position a support element carrying at least two rolling plates which are selectively mobile from and towards a rolling position in contact with the cigarette and filter groups to retain the cigarette and filter groups against the conveyor roller at a rolling station.

9 Claims, 2 Drawing Figures

DEVICE FOR APPLYING FILTERS TO CIGARETTES

Figure 1:
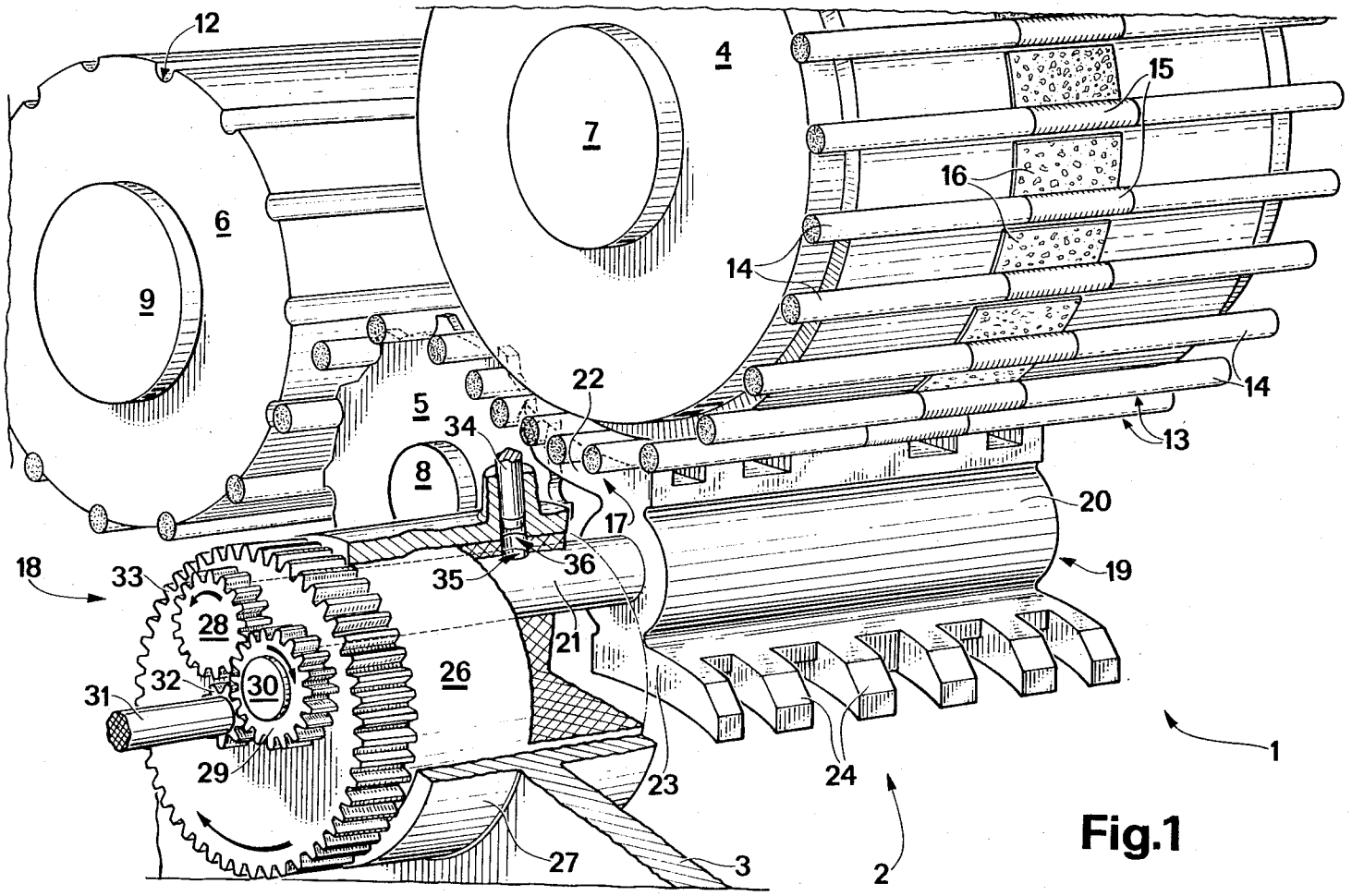

This invention relates to a device for applying filters to cigarettes.

In machines of known type for applying filters to cigarettes, commonly known as filter fitting machines, the filters are connected to the cigarettes by gummed bands of paper material, which are rolled about groups each constituted by two axially aligned cigarettes, between which there is interposed a filter having a length double that of a final cigarette with filter.

Said bands are usually rolled about said groups during their conveying by a conveyor roller, which retains them by suction inside axial seats provided on its peripheral surface. An arcuate plate, coaxial with said roller and, when in its operating position, separated from the peripheral surface of the roller by a distance slightly less than the diameter of the cigarettes, causes the groups, by means of friction, to emerge from their seats and to roll about their own axis along the roller surface until each group enters the seats next to its original one. During this rolling, a connection band, previously disposed in contact with the conveyor roller surface in proximity to said group, wraps about each group.

Said arcuate plate is normally supported by a support element rotatable about an axis and provided with at least two of said arcuate plates uniformly distributed about said axis. Whenever it is necessary to clean or replace the roller plate, said support element can be rotated, both when the machine is at rest and in motion, by which the plate is withdrawn from said operating position and can be replaced with another.

Because of the very high operating rate attained by modern filter fitting machines, slippage of said groups takes place relative to the peripheral surface of the conveyor roller during the described rolling operation. Said slippage, even if of very small extent, is particularly damaging in that it can be sufficient to prevent correct spontaneous entry of the connected groups into the relative seats. In order to obviate such a drawback, it is known to use immediately downstream of said rolling station suitable phasing elements able to nullify the positioning errors of the groups, and possibly to withdraw them in order to feed them towards subsequent processing stations. The presence of such phasing elements, usually in the form of rollers provided peripherally with suitably configured equidistant seats, means that rolling devices of the aforesaid type either cannot be used or makes their use difficult and not free from drawbacks.

In this respect, in order for the described rotation of the roller plate support element to take place, a certain space is required, and this is not available because of the presence in tha phasing element. The only means by which this rotation can be take place in devices of known type is to distance said support element from the conveyor roller before rotating it. However, this method makes plate replacement very lengthy and complicated, and consequently gives rise to considerable drawbacks when this replacement is done while the filter fitting machine is in operation, because a very large number of unconnected or damaged groups have to be discarded.

The object of the present invention is therefore to provide a device for applying filters to cigarettes in which the described replacement of the roller plates can be carried out rapidly and simply without them interfering with said phasing element during the replacement operation.

This object is attained according to the present invention by a device for applying filters to cigarettes, comprising a conveyor roller provided with a plurality of uniformly distributed peripheral axial seats arranged to each receive a respective group comprising at least one cigarette and relative filter element which are axially aligned with each other, and a rolling device cooperating with each of said groups at a rolling station in order to cause the group to roll along a peripheral surface of said roller, characterised in that said rolling device comprises a support member rotatable about a first axis, a support element mounted on said support member and rotatable about a second axis parallel to said first axis and eccentric to said support member, at least two rolling elements extending from said support element and uniformly distributed about said second axis, and transmission means interposed between said first and said second axis in order to rotate said support element about said second axis in response to a rotation of said support member about said first axis, and having a transmission ratio which is an inverse function of the number of said rolling elements.

Figure 2:
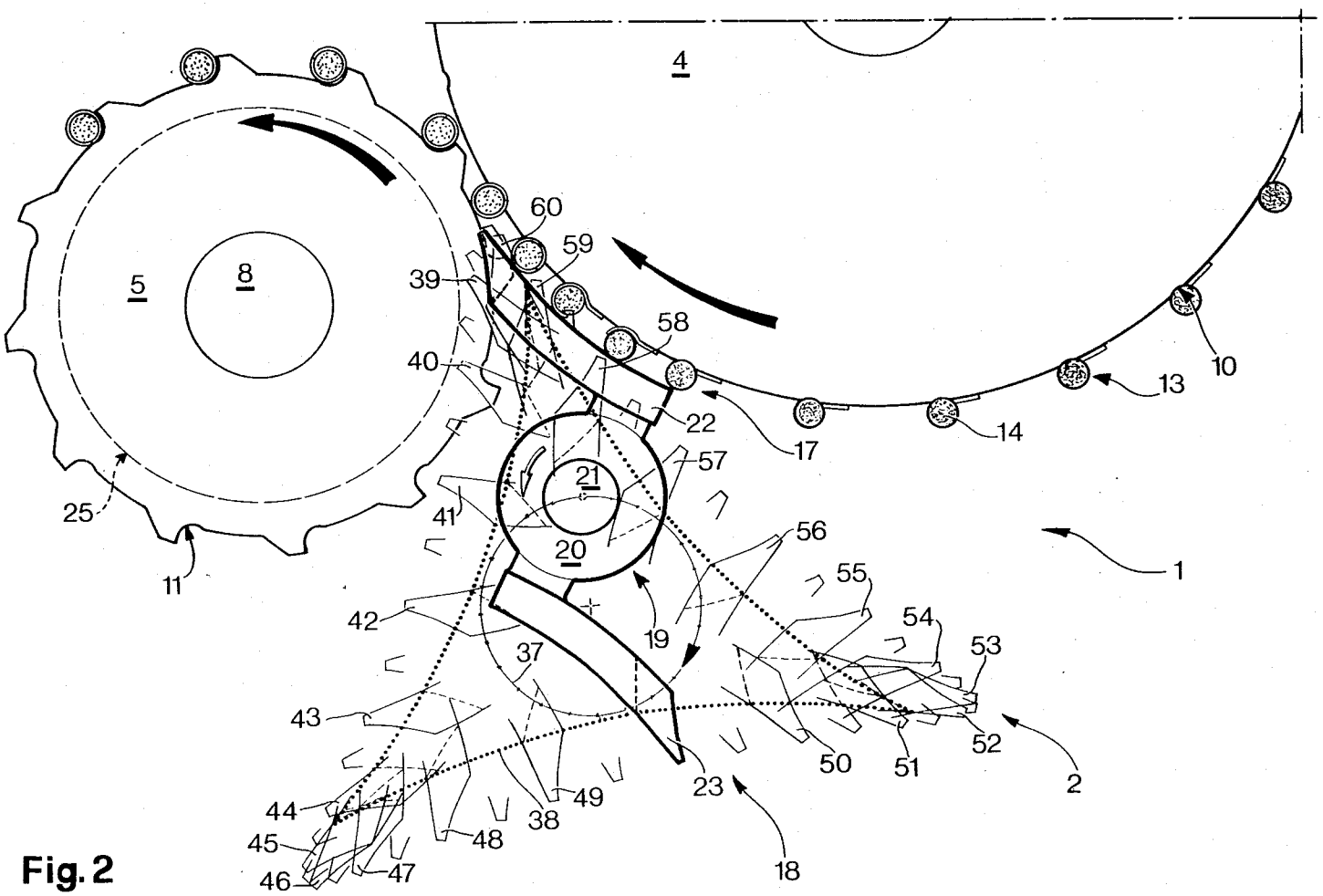

Further characteristics and advantages of the present invention will be apparent from the detailed description given hereinafter of a preferred embodiment, illustrated by way of non-limiting example on the accompanying drawings in which: FIG. 1 is a diagrammatic perspective view of a preferred embodiment of the device according to the present invention; and FIG. 2 is a diagrammatic side view of the device of FIG. 1.

In FIG. 1, the reference numeral 1 indicates overall a device for applying filters to cigarettes, forming part of a filter fitting machine 2, and partly supported by a vertical wall 3 of this latter.

The device 1 comprises three rollers 4, 5 and 6 of horizontal axis, of which the first two, substantially tangential to each other, are keyed on the respective shafts 7 and 8 driven with clockwise and anti-clockwise rotary motion respectively. The roller 5 is also substantially tangential to the roller 6, which is keyed on a shaft 9 rotating clockwise. Said roller 4, 5 and 6 are provided on their periphery with a plurality of respective axial grooves 10, 11 and 12 defining a like number of seats each arranged to receive a respective group 13 constituted by two axially aligned cigarettes 14 between which there is disposed a filter tip or filter element 15 of length double that of the filter tip of a finished filter cigarette.

The groups 13 reach the roller 4, from processing stations, not shown, and are retained in the grooves 10, 11 and 12 during their transfer from the roller 4 to the roller 5 and from this latter to the roller 6, by suction means, not shown.

The roller 4 is also provided on its periphery with suction retention means, not shown, arranged to receive and retain, immediately upstream of each groove 10, a band 16 of paper material fed by means, not shown, and arranged to connect together the elements 14 and 15 of a relative group 13.

Below the roller 4 and in proximity to that zone of this latter which is adjacent to the roller 5, in a position corresponding with a zone defined hereinafter as the rolling station or position and indicated by 17, there is situated a rolling device for the groups 13 which is indicated overall by 18 and forms part of the device 1.

The device 18 comprises a rolling element 19 which itself comprises a hollow cylindrical member or support element 20 keyed on to a shaft 21 parallel to the shafts 7, 8 and 9. Said member 20 supports in diametrically opposing positions two substantially rectangular identical rolling plates 22 and 23 of arcuate shape, of which in FIG. 1 the first is shown above and the second below the member 20, and which are disposed in positions substantially tangential to this latter with their concavity facing outwards.

When in the situation shown in FIG. 1, the plate 22 is disposed in an operating position coaxial to the roller 4 and facing its peripheral surface, and is spaced apart from said surface by a distance slightly less than the diameter of a group 13.

The plates 22 and 23 are disposed in non-symmetrical positions one to the other about a plane passing through the axes of the cylindrical member 20 and roller 4, and extend in opposite directions outwards from said plane. Each plate 22, 23 is provided, along an outer edge parallel to the axis of the member 20, with a plurality of adjacent teeth 24 arranged to slidably engage in respective peripheral circumferential slots 25 (of which the base surface is shown in FIG. 2 by dashed lines) present in the periphery of the roller 5. More specifically, the plate 22, when in the situation shown in FIG. 1, is disposed relative to the rollers 4 and 5 in such a manner that its teeth 24 project into the slots 25 of the roller 5.

The shaft 21 is eccentrically supported in a rotatable manner by a cylindrical support member 26, which is itself supported rotatably by a tubular member 27 which traverse the wall 3. On the free end of said shaft 21 there is keyed a gear wheel 28, which engages with a gear wheel 29 keyed on to a pin 30 idly carried in an eccentric position by the cylindrical member 26. This latter is traversed coaxially by an angularly fixed pin 31, on which there is keyed a gear wheel 32 engaged with the gear wheel 29.

On the periphery of the cylindrical member 26 there is provided a ring gear 33 which constitutes the final linkage element of a drive unit arranged to rotate the cylindrical member 26 clockwise.

The tubular member 27 is traversed by a pin or locking means 34 directed towards the shaft 21 and arranged to engage a bore 35 provided therein and a bore 36 provided in the cylindrical member 26.

For a better understanding of the operation of the device according to the invention, reference will now be made to FIG. 2 in which the reference numeral 37 indicates a circumference traversed by a generic point of the axis of the shaft 21, and the reference numeral 38 indicates a closed curve traversed by a point of the plate 22 and by a corrsponding point of the plate 23 as the cylindrical member 26 rotates. For the points of the plates 22 and 23 considered in FIG. 2, said curve 38 is substantially of tricuspid hypocycloid configuration, but for the other points of said plates 22 and 23 and for different dimensions of the rolling device 18 it can assume any transcendental curve form.

When in use, the group 13 are fed in succession by means, not shown, into the grooves 10 of the roller 4 during normal operation of the filter fitting machine. It will be assumed for the moment that the rolling device 18 has its plate 22 facing said roller 4. As each group 13 reaches the rolling station 17, it is extracted from the relative groove 10 by the inner edge (or rear edge with respect to the feed direction of the groups 13) of the plate 22, and begins to rotate between this latter and the peripheral surface of the roller 4.

As a result of this, the band 16 disposed in proximity to said group 13 is rolled about the central zone thereof, to thus form the connection between the cigarettes 14 and the filter 15.

After completely traversing the passage defined by the plate 22 and periphery of the roller 4, each group 13 enters the next groove 10 to its original one, and is then inserted into a groove 11 of the roller 5. Each group 13 then passes from this latter groove to a groove 12 of the roller 6, to be fed to subsequent processing stations, not shown. Whenever it is required to replace or clean the plate 22, the pin 34 must be withdrawn from the bore 35 of the shaft 21 in order to make this latter freely rotatable inside the cylindrical member 26. This operation can obviously be effected either manually or automatically.

The ring gear 33 is then made to operate either under manual or automatic control, and rotates the cylindrical member 26 clockwise through an arc of 180°. The gear wheel 29 consequently begins to rotate clockwise about its axis as it rolls about the fixed gear wheel 32, and causes the gear wheel 28 to rotate anti-clockwise about its axis and to at the same time, move along said circumference 37.

As a consequence of this, during the rotation of the cylindrical member 26 the plates 22 and 23 exchange their positions by moving along trajectories which are such as not to cause said plates 22 and 23 to interfere with the rollers 4 and 5. More precisely, the plate 22 moves along a path which causes that end provided with the teeth 24 to occupy in succession the positions indicated in order by the numbers 39 to 49, until it reaches the position previously occupied by the plate 23. In the meantime, this latter occupies in succession the positions indicated by the numbers 50 to 60, until it reaches the rolling station 17. After 180° of rotation of the cylindrical member 26, the ring gear 33 is halted, ant the locking pin 34 is re-engaged with the bore 35 of the shaft 21.

As stated heretofore, the curve 38 represents the trajectories followed by two corresponding points of the plates 22 and 23 during the described movement, and clearly shows how the device 1 according to the invention enables the positions of the plates 22 and 23 to be exchanged without them interfering with the rollers 4 and 5.

Within the principle of the invention, numerous modifications can be made to the described device without leaving the scope of the inventive idea.

For example, by suitably varying the ratios, the number and location of the gear wheels 28, 29 and 32, the hollow cylindrical member 20 can support a number of plates greater than two.

Moreover, the gear train comprising the gear wheel 29, 29 and 32 can be replaced by any type of gear train or equivalent linkage able to determine the described movements of the plates 22 and 23.

What I claim is:

1. A device for applying filters to cigarettes, comprising a conveyor roller provided with a plurality of uniformly distributed peripheral axial seats arranged to each receive a respective group comprising at least one cigarette and a relative filter element which are axially aligned with each other, and a rolling device cooperating with each of said groups at a rolling station in order to cause the group to roll along a peripheral surface of said roller, characterised in that said rolling device comprises a support member rotatable about a first axis, a support element mounted on said support member and rotatable about a second axis parallel and eccentric to said first axis, a rolling element, extending from said support element and uniformly distributed about said second axis, comprising at least two rolling plates extending therefrom, whereby one rolling plate can retain the cigarette and filter groups against the conveyor roller at the rolling station while at least one other rolling plate may be cleaned, and transmission means interposed between said first and said second axis in order to rotate said support element about said second axis in response to a rotation of said support member about said first axis.

2. A device as claimed in claim 1, wherein said support element comprises a cylindrical member keyed on a shaft mounted eccentrically on said support member and rotatable relative thereto.

3. A device as claimed in claim 2, wherein said transmission means comprise a fixed gear wheel coaxial to said first axis, a second gear wheel coaxial to said second axis and keyed on said shaft, and at least one further idling gear wheel interposed between the first two gear wheels.

4. A device as claimed in claim 3, wherein locking means are provided for angularly locking said support element relative to said support member.

5. A device as claimed in claim 4, wherein each of said rolling plates comprises an arcuate contact surface.

6. A device as claimed in claim 3, wherein each of said rolling plates comprises an arcuate contact surface.

7. A device as claimed in claim 2, wherein locking means are provided for angularly locking said support element relative to said support member.

8. A device as claimed in claim 2, wherein each of said rolling plates comprises an arcuate contact surface.

9. A device as claimed in claim 1, wherein each of said rolling plates comprises an arcuate contact surface.

* * * * *